US006529121B2

(12) United States Patent
Bush

(10) Patent No.: US 6,529,121 B2
(45) Date of Patent: Mar. 4, 2003

(54) HAND-WORN WARNING DEVICE AND METHOD

(76) Inventor: Irving Bush, 3811 Ocean Front Walk, Marina del Rey, CA (US) 90292

( * ) Notice: Subject to any disclaimer, the term of this patent is extended or adjusted under 35 U.S.C. 154(b) by 0 days.

(21) Appl. No.: 09/903,968

(22) Filed: Jul. 11, 2001

(65) Prior Publication Data

US 2003/0011469 A1 Jan. 16, 2003

(51) Int. Cl.[7] ..... G08B 27/00

(52) U.S. Cl. ..... 340/326; 340/321; 340/328; 340/432; 340/574

(58) Field of Search ..... 340/326, 328, 340/321, 432, 574

(56) References Cited

U.S. PATENT DOCUMENTS

| | | | | |
|---|---|---|---|---|
| 1,173,269 A | | 2/1916 | Heidemann | |
| 1,199,710 A | | 9/1916 | Newton et al. | |
| 1,267,436 A | * | 5/1918 | Martin | |
| 3,638,011 A | * | 1/1972 | Bain et al. | 340/321 |
| 4,635,516 A | | 1/1987 | Giannini | 84/1.01 |
| D303,406 S | | 9/1989 | Dean et al. | D21/59 |
| 5,001,462 A | | 3/1991 | Seemann et al. | 340/5.74 |
| 5,177,467 A | | 1/1993 | Chung-Piao | 340/574 |
| 5,255,167 A | | 10/1993 | Toussaint et al. | 361/103 |
| D349,364 S | | 8/1994 | Rasmussen | D29/113 |
| 5,365,213 A | * | 11/1994 | Paull et al. | 340/321 |
| 5,638,767 A | | 6/1997 | Bush | 116/139 |
| 6,006,357 A | | 12/1999 | Mead | 2/160 |
| 6,112,330 A | | 9/2000 | Bryan | 2/160 |

FOREIGN PATENT DOCUMENTS

| | | | |
|---|---|---|---|
| WO | WO93/08709 | 5/1993 | A41D/19/00 |

* cited by examiner

*Primary Examiner*—Daniel J. Wu
*Assistant Examiner*—Hung Nguyen

(57) ABSTRACT

A hand worn warning or signaling system comprises a hand-wear article such as a glove or a band to be worn around the wrist or fingers, having a sound generating and light generating element. According to a preferred embodiment, the system comprises a pair of gloves, one having a sound generating element and the other having a light generating element, allowing the user to select between generating a sound or light alert or both. The warning system may also have a finger or thumb accessible activation button.

3 Claims, 2 Drawing Sheets

HAND-WORN WARNING DEVICE AND METHOD

BACKGROUND OF THE INVENTION

1. Field of the Invention

This invention relates to warning or signaling devices and more particularly to hand-worn warning or signaling devices, and methods of using the same.

2. Description of the Related Art

Warning or signaling devices incorporated into hand-worn articles such as gloves or hand bands which can be worn around the hand or wrist can offer a convenient way of providing warnings and signals right at the user's finger tips.

U.S. Pat. No. 6,006,357 discloses a signaling glove having a reflective surface, including a light emitting source adapted to illuminate the reflective surface. This device is designed to reflect light and does not include a sound alarm.

U.S. Pat. No. 6,112,330 discloses a device for attaching a bell, a beeper or a signaling whistle or also a signaling lamp to a glove or sports protector. However, such device is not permanently integrated into the glove.

U.S. Pat. No. 5,177,467 is discloses a glove having a plurality of illuminators and buzzers and at least one trigger switch formed on an inside surface portion of the glove, whereby upon a grasping of a wearer's hand or closing of the wearer's fingers, the trigger switch will be actuated to produce a sound and light alarm. Such a device does not give a user enough control over triggering the alarm, as the alarm can be triggered when the user simply intends to clasp the bicycle handle or clench his or her fist, and does not allow the user to choose between a sound or light alarm, but actuates both sound and light alarms together.

A warning or signaling system is needed which gives a user easy controllable access to activating either a sound or light alert, and can be worn comfortably on the hand.

SUMMARY OF THE INVENTION

The present invention provides a compact, easy access controllable warning or signaling system which can be used by bicyclists, roller skaters, roller-bladers, is pedestrians, snow boarders, skiers, road construction workers and the like to alert others crossing their path including other riders or oncoming vehicles, or as a safety alarm to ward off an attacker or alert of an attacker, or as an entertainment device, among other uses.

The warning system has sound and light generating elements incorporated into a hand-worn article such as a glove or hand band. The device may have a thumb and/or finger accessible activation switch, which allows the user easy controlled access for activating either the sound or light alarms.

According to one embodiment, a warning system comprises a pair of gloves, one having a light generating element, and the other having a sound generating element, whereby either a light or sound can be generated depending on which activation button is pressed.

Another embodiment comprises a band, or a pair of bands, which can be worn around the wrist or fingers of the hand, having a sound and/or light generating element.

These and other objects and advantages of the present invention will be apparent from a review of the following specification and accompanying drawings.

OBJECTS OF THE INVENTION

It is an object of the present invention to provide a compact, easy access, controllable warning or signaling system which can be used by bicyclists, roller skaters, roller-bladers, pedestrians, snow boarders, skiers, and the like to alert others crossing their path or to alert oncoming vehicles, or as a safety alarm to ward off an attacker or alert of an attacker, or as an entertainment device.

It is a further object of the present invention to provide a sound and light warning or signaling system incorporated into a hand-worn article such as a glove or band worn on the hand or wrist.

It is a further object of the invention to provide a sound and light warning or signaling system incorporated into a hand-worn article, which gives the user control over optionally activating either the light or sound alarm or both.

It is a further object of the present invention to provide a sound and light warning or signaling system incorporated into a hand-worn article, having a finger and/or thumb tip accessible activating switch.

These and other objects and advantages of the present invention will be apparent from a review of the following specification and accompanying drawings.

DESCRIPTION OF THE PREFERRED EMBODIMENTS

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
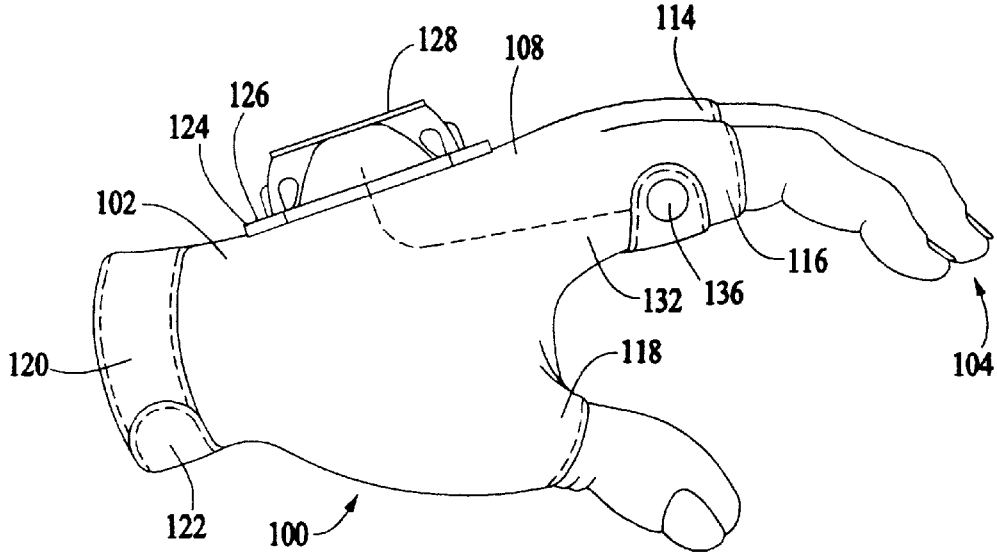
FIG. 1 is a perspective view of a glove according to a preferred embodiment of the present invention, worn on a user's hand.
Figure 2:
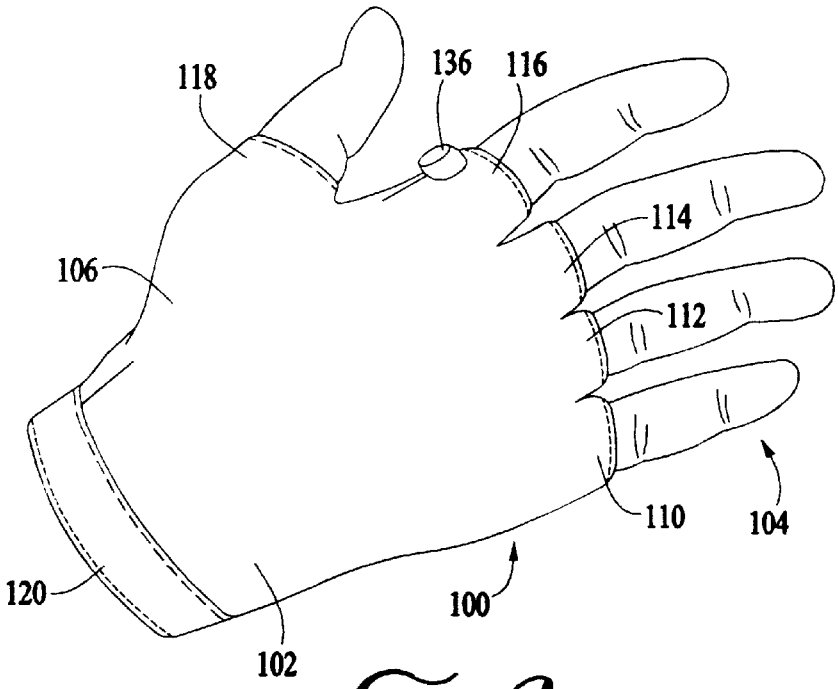
FIG. 2 is a front elevation view of the glove of FIG. 1.
Figure 3:
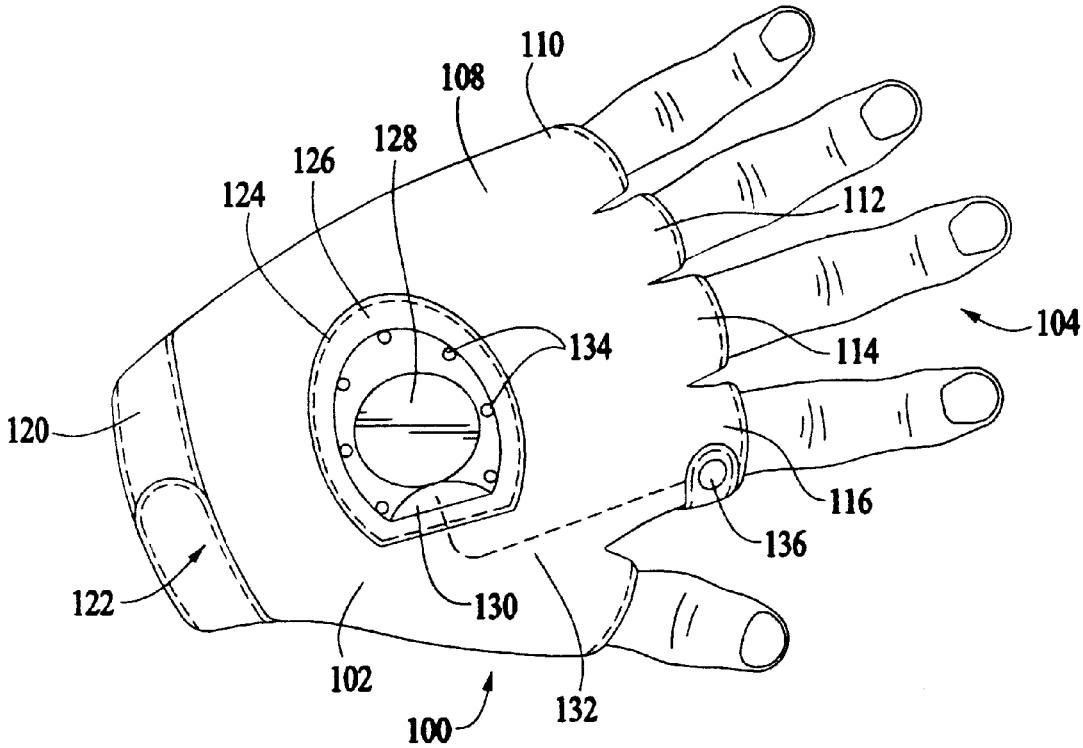
FIG. 3 is a rear elevation view of the glove of FIG. 1, having a light generating system.

FIGS. 1–3 illustrate a glove having a warning or signaling system comprising sound and/or light generating elements according to a preferred embodiment of the present invention.

Glove 100 includes a glove body, or body portion, 102, which is adapted to be worn on a user's hand 104. Body portion 102 includes a palm side 106 and a back side 108, which respectively cover portions or all of the palm and back sides of the user's hand when the glove is worn, and portion 102 may further includes finger regions 110–116 and a thumb region 118 that cover portions or all of the user's fingers and thumb.

As shown, body portion 102 further includes four truncated finger regions 110–116 and a truncated thumb region 108 that are each adapted to extend over a portion of the user's finger or thumb. This enables the glove to be worn by a variety of users with different finger lengths. Glove 100 may include longer, or completely enclosed finger and thumb regions, as well as a single finger region that encloses all of a user's fingers in a single enclosure. This latter embodiment would most likely be used in cold weather, and the glove may further include an internal hand-warming disposable or reusable heat pack.

Additionally, the glove 100 may include an elastic wrist region 120 with a Velcro strap 122, such that the glove can be snuggly fitted around the user's wrist.

Although a specific glove design is shown in the figures, this invention is applicable to any hand-worn article having an alert system in accordance with the present invention, including but not limited to conventional gloves, gloves having truncated finger regions, mittens, sports gloves, motorcycle gloves, and roller-blading gloves. Such hand worn article may incorporate additional features, for example, a skating glove may incorporate a palm protection pad to minimize injury to the hand in the event that the skater falls down. Glove 100 could come in a variety of shapes and sizes. For example, it may have a mitten shape, in which the user's fingers are all housed within a common enclosed portion of the glove. Glove 100 may be formed from any type of material including, inter alia, a stretchable material, an absorbent fabric, natural and synthetic leathers, rubber, fabric, canvas, or a combination thereof. Additionally, the glove may be formed from more durable materials including flame-, chemical- and/or water-retardant or proof materials to adapt the gloves for use in a variety of applications.

Glove 100 further includes a warning system circuitry comprising sound generating and/or light generating elements, preferably mounted within a cover 126 on the back side 108 of the body portion 102, a power source which is preferably a battery, and an activation button 136. It should be understood that this invention is not limited to a sound and/or light-generating element mounted on the back side 108 of the body portion 102, and can be located anywhere on the glove.

The activation button 136 is preferably positioned on the index finger region 116 such that the user can easily press the button with his or her thumb in order to generate light and or sound. Such positioning of the activation button 136 minimizes the chance of accidentally pressing the button 136. The activation button 136 may be placed in other locations to achieve easy controlled activation access, for example, for a glove having covered finger regions, the button 136 may be placed on the tip of any of the finger regions, or on the tip of the thumb region such that it can be activated by a user pressing his or her thumb tip against the finger tip region.

According to a preferred embodiment, the cover 126 includes a battery encasement for a battery (e.g. CR 2016 3V Lithium) enclosed within a recessed portion of the cover 126, having a removable top 128, such that the battery can be removed and replaced when worn out, or recharged and reused. The cover 126 including top 128 may be formed from plastic or any other suitable lightweight material which is sufficiently flexible to conform to the contours of the user's hand providing minimum restriction to the user's range of motion and positions. Additionally, the cover 126 including top 128 may be water resistant for a water resistant enclosure.

The cover 126 preferably has an approximately oval contour truncating to a straight edge at a side 130 adjacent to the thumb region for minimizing the restriction to the user's range of motion. The battery encasement and top 128 are preferably the same shape as the battery. As shown in the figures, the top 128 is round, for encasing a round battery. It should be understood however, that the cover 124 and top 128 are not limited to oval and round contours, and it is within the scope of the present invention that other shapes may be used as well. For example, the cover may have an ornamental shape such as a flower or star.

An insulated wire 132 within the fabric of the glove forms the electrical connection between the activation button 136, and system circuitry, such that the sound generating and/or light generating element is activated when the user presses the button 136.

According to a preferred embodiment, a system comprising a light generating element includes a plurality of pin lights 134 arranged equidistantly around the cover 126, as shown in FIG. 3. The pin lights 134 may remain steadily on once activated, or may flash in unison or in an alternating pattern. Such pin lights may be colored, for example red, or clear. Other types of lights may be used as well. For example, a light generating element may comprise a single tube formed around the perimeter of the cover 126 which lights upon activation. Many embodiments will be apparent to one skilled in the art.

An warning system comprising a sound generating element according to the present invention may produce any type of alerting sound including, inter alia, a bell chime, a ring, a bussing sound, a musical chime, a dog barking sound, or the sound of a human yelling "Out of my way!"

The sound and or light alerts may be generated continuously by pressing the button 136, and stop upon the user's release of the button 136, or may be continuously generated by one press of the button 136, without the user having to hold down the button 136, after which the system would either stop automatically, or stop once the button 136 is pressed again.

A warning system according to the present invention may comprise a pair of gloves, one having a light generating element, and the other having a sound generating element, whereby the user can choose between activating either or both by pressing the corresponding activation button on either or both gloves.

Alternatively, a glove may have both a sound generating element and a light generating element with a button which activates both together. A glove having both a sound and light generating element may have two activation buttons, one for activating the sound generating system, and the other for activating the light generating system, wherein a user can choose to activate either system or both together.

Figure 4:
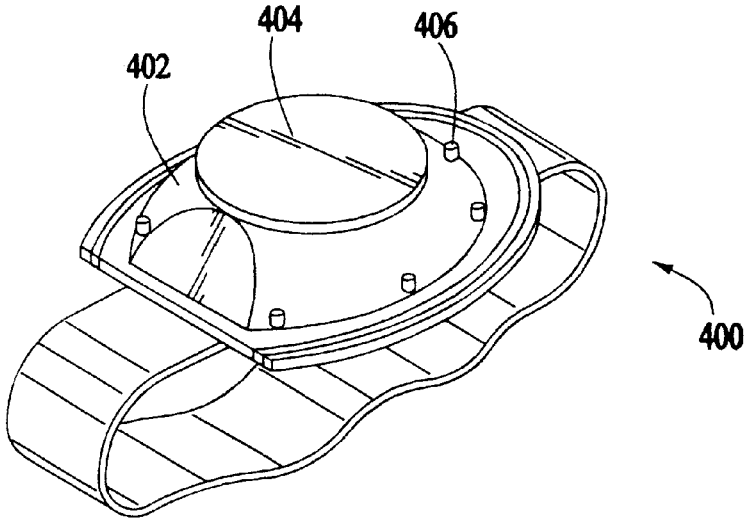
FIG. 4 is a perspective view of a band according to a preferred embodiment of the present invention.

FIG. 4 illustrates a band 400 having a warning system circuitry, similar to the glove of FIGS. 1–3. Band 400 may be formed from any type of material including, inter alia, a stretchable material, an absorbent fabric, natural and synthetic leathers, rubber, fabric, canvas, or a combination thereof. The band may be adjustable in size, for example, by having Velcro ends. Additionally, the band may be formed from more durable materials including flame-, chemical- and/or water-retardant or proof materials to adapt the gloves for use in a variety of applications. The band may be worn around the user's wrist or around the four fingers, excluding the thumb, and can be worn on top of a glove.

The band's warning system circuitry comprises sound generating and/or light generating elements, preferably mounted within a cover 402 attached to the band 400, a power source which is preferably a battery, and an activation button, similar to the sound generating circuitry of the glove 100.

The activation button can be positioned at any convenient location on the band 400 including on the cover 402 itself.

According to a preferred embodiment, the cover 402 includes a battery encasement for a battery (e.g. CR 2016 3

V Lithium) enclosed within a recessed portion of the cover 402 having a removable top 404, such that the battery can be removed and replaced when worn out, or recharged and reused. The cover 402 including top 404 may be formed from plastic or any other suitable lightweight material. Additionally, the cover 402 including top 404 may be water resistant for a water resistant enclosure.

As with the cover 126, the cover 402 preferably has an approximately oval contour truncating to a straight edge. The battery encasement and top 404 are preferably the same shape as the battery. As shown in the figures, the top 404 is round, for encasing a round battery. It should be understood however, that the cover 402 and top 404 are not limited to oval and round contours, and it is within the scope of the present invention that other shapes may be used as well. For example, the cover may have an ornamental shape such as a flower or star.

According to a preferred embodiment, a system comprising a light generating element includes a plurality of pin lights 406 arranged equidistantly around the cover 402, as shown in FIG. 4. The pin lights 406 may remain steadily on once activated, or may flash in unison or in an alternating pattern. Such pin lights may be colored, for example red, or clear. Other types of lights may be used as well. For example, a light generating element may comprise a single tube formed around the perimeter of the cover 402 which lights upon activation. Many embodiments will be apparent to one skilled in the art.

An warning system comprising a sound generating element according to the present invention may produce any type of alerting sound including, inter alia, a bell chime, a ring, a bussing sound, a musical chime, a dog barking sound, or a voice sound.

The sound and or light alerts may be generated continuously by pressing the activation button, and stop upon the user's release of the button, or may be continuously generated by one press of the button, without the user having to hold down the button, after which the system would either stop automatically, or stop once the button is pressed again.

A warning system according to the present invention may comprise a pair of bands 400, to be worn on both hands, one having a light generating element, and the other having a sound generating element, whereby the user can choose between activating either or both by pressing the corresponding activation button on either or both bands.

Alternatively, the band 400 may have both a sound generating element and a light generating element with a button which activates both together. A band having both a sound and light generating element may have two activation buttons, one for activating the sound generating system, and the other for activating the light generating system, wherein a user can choose to activate either system or both together.

While the present invention has been described with regards to particular embodiments, it is recognized that additional variations of the present invention may be devised without departing from the inventive concept.

What is claimed is:

1. A hand-wear article comprising:

a pair of gloves;

a light generating element on one of said gloves, and a sound generating element on other of said gloves;

further comprising an activation button on each of said gloves for activating the light and sound generating element of each glove respectively;

wherein said activation button is thumb accessible and located on a portion of the glove corresponding to the lower portion of index finger, on a side adjacent to the thumb tip portion;

wherein said light generating element and said sound generating element is located on a center portion of each of said gloves corresponding to the back of the hand; and wherein said light generating element comprises a plurality of flashing pin lights of at least two different colors arranged to form a closed curve, the pin lights flashing in an alternating pattern around the closed curve.

2. A glove comprising:

a warning system on the glove, said warning system comprising a sound generating element, or a light generating element, or both; and at least one thumb accessible button for activating said warning system;

wherein said button is on a portion of the glove corresponding to the lower portion of index finger, on a side adjacent to the thumb tip portion;

wherein said light generating element comprises a plurality of flashing pin lights of at least two different colors arranged to form a closed curve;

wherein said warning system is located on a portion of the glove, corresponding to the back of the hand.

3. A hand-wear article comprising:

a pair of hand bands each to be worn on either of both hands of user, a light generating element on one of said bands, and a sound generating element on the other of said bands;

means for activating said lighting means and said sound generating means located on the light and sound generating means;

wherein said light generating element and said sound generating element is located on a portion of each of said hand bands corresponding to the back of the hand; and wherein said light generating element comprises a plurality of flashing pin lights of at least two different colors arranged to form a closed curve, the pin lights flashing in an alternating pattern around the closed curve;

wherein said bands can be worn either around the user's wrists or four fingers excluding the thumb.

* * * * *